United States Patent [19]

Fujita

[11] Patent Number: 5,073,463

[45] Date of Patent: Dec. 17, 1991

[54] METHOD OF MANUFACTURING A PHOSPHOR SCREEN FOR CATHODE RAY TUBES

[75] Inventor: Koji Fujita, Kanagawa, Japan

[73] Assignee: Sony Corporation, Tokyo, Japan

[21] Appl. No.: 406,245

[22] Filed: Sep. 12, 1989

[30] Foreign Application Priority Data

Sep. 29, 1988 [JP] Japan ..... 63-245502

[51] Int. Cl.[5] ..... G03C 5/00

[52] U.S. Cl. ..... 430/28; 427/64; 427/68; 430/23

[58] Field of Search ..... 427/64, 68; 430/23, 430/28

[56] References Cited

U.S. PATENT DOCUMENTS 3,966,474 6/1976 Harper ..... 427/68
3,981,729 9/1976 Saulnier ..... 427/68
4,139,657 2/1979 Watanabe ..... 427/68
4,485,158 11/1984 Harper ..... 427/68

*Primary Examiner*—Janyce Bell
*Attorney, Agent, or Firm*—Hill, Van Santen, Steadman & Simpson

[57] ABSTRACT

A method of manufacturing a phosphor screen for a cathode ray tube comprises the step of forming a suspension of a phosphor material and a resin particle having an average particle size of 0.5 to 20 micrometers in an aqueous solution containing a photosensitive resin, a dispersing agent and a binder; coating an inner surface of a cathode ray tube with the suspension to form a phosphor screen; then forming an intermediate layer on the phosphor screen; then forming a metal back layer on the intermediate film; and finally baking the whole product so that the brightness of the phosphor screen of the cathode ray tube can be increased.

1 Claim, 5 Drawing Sheets

METHOD OF MANUFACTURING A PHOSPHOR SCREEN FOR CATHODE RAY TUBES

BACKGROUND OF THE INVENTION

1. Field of the Invention

The present invention relates generally to a method of manufacturing a phosphor screen for a cathode ray tube and more particularly to a method of manufacturing a phosphor layer which becomes the parent of a phosphor screen of a cathode ray tube.

2. Description of the Prior Art

As a method of manufacturing a phosphor screen for a cathode ray tube, particularly a color cathode ray tube, there has been known a so-called PVA (polyvinyl alcohol) slurry method.

According to the PVA slurry method, phosphor particles are suspended in an aqueous solution, which contains a photosensitive resin, such as ammonium bichromate or the like, a dispersing agent (surface active agent) and a binder, such as polyvinyl alcohol or the like, to thereby produce a so-called phosphor slurry. Then, the phosphor slurry is coated on the inner wall of a cathode ray tube, namely, the inner surface of its panel, which already has formed thereon a light absorption layer, for example a carbon stripe. After the phosphor slurry has been dried, it is then exposed to light by using a color selection electrode (for example, aperture grill) as an optical mask. After the exposing process, the color selection electrode is removed and the product is developed by water, thereby forming phosphor stripes of a predetermined pattern to thus form a phosphor screen on the inner surface of the panel. In general, the similar processes are sequentially repeatedly carried out to form a green phosphor stripe, a blue phosphor stripe and a red phosphor stripe. Then, the product is dried and is uniformly coated with an aqueous solution containing, for example, an acrylic resin (for example a resin sold under the trade name PRIMAL). The product is again dried to form an acrylic resin-based film, which is a so-called intermediate film on the phosphor stripes. Thereafter, a metal back layer is formed on the intermediate film by an aluminum vapor deposition process and then the whole of the product is baked to remove the intermediate film formed beneath the metal back layer. Thus, the process for manufacturing a phosphor screen is ended.

In the prior art method of manufacturing a phosphor screen for a color cathode ray tube, however, as shown in FIGS. 1A and 1B, phosphor particles 21 are crowded or overlap one another on a panel 22 so that they are brought in contact with one another in a surface contact fashion. Also, each single phosphor particle 21 has many contact portions. Thus, when the phosphor particle 21 is activated by the bombardment of electrons to emit a light, the light emitted from each phosphor particle 21 cannot pass through the phosphor particle 21 due to the existence of many contact portions of the phosphor particles 21 and, hence, the brightness of the phosphor screen cannot be demonstrated sufficiently. In FIG. 1B, reference numeral 23 designates a metal back layer.

Further, in the stage for manufacturing the phosphor screen, as shown in FIG. 2A, the phosphor particles 21 are dispersed in a displaced condition and a so-called pinhole H is formed through the phosphor particles 21 to communicate with the panel 22. The metal back layer 23, which will be formed in the later stage, enters the pinhole H and contacts with or internally touches the inner surface of the panel 22, as shown in FIG. 2B. This condition of the metal layer 23 contacting the screen at the pinhole H will cause the brightness of the phosphor screen to be considerably lowered.

SUMMARY OF THE INVENTION

It is an object of the present invention to provide an improved method of manufacturing a phosphor screen for a cathode ray tube.

It is another object of the present invention to provide a method of manufacturing a phosphor screen for a cathode ray tube in which contact portions between adjacent phosphor particles are reduced so that the brightness of a phosphor screen can be increased.

It is still another object of the present invention to provide a method of manufacturing a phosphor screen for a cathode ray tube which screen has an increased brightness because the method prevented the metal back layer from entering any pinhole.

According to an aspect of the present invention, there is provided a method of manufacturing a phosphor screen for a cathode ray tube comprising the steps of:

(a) preparing a suspension by suspending a phosphor material and a resin particle in an aqueous solution containing a photosensitive resin, a dispersing agent and a binder;

(b) coating an inner surface of a cathode ray tube with the suspension and processing the suspension to form a phosphor screen;

(c) forming an intermediate layer on said phosphor screen;

(d) forming a metal back layer on said intermediate film to form a product having an inner surface covered by the phosphor screen, the intermediate layer and the metal back layer; and then (e) baking the product.

These and other objects, features and advantages of the present invention will be readily apparent in the following detailed description of a preferred embodiment when read in conjunction with the accompanying drawings, in which like reference numerals identify the same or similar parts.

DETAILED DESCRIPTION OF A PREFERRED EMBODIMENT

Figure 1A:
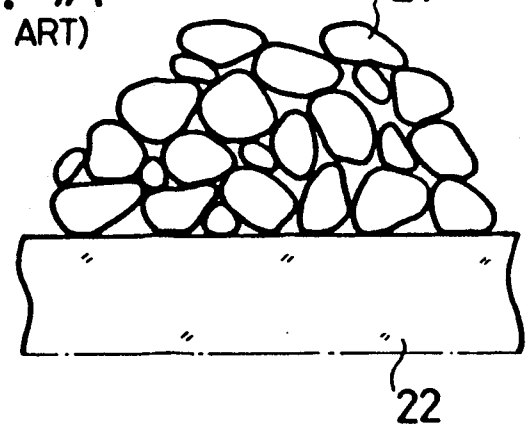
FIG. 1A (PRIOR ART)
FIGS. 1A and 1B are schematic diagrams used to explain the problems of a phosphor material of a prior art phosphor screen, respectively.
Figure 1B:
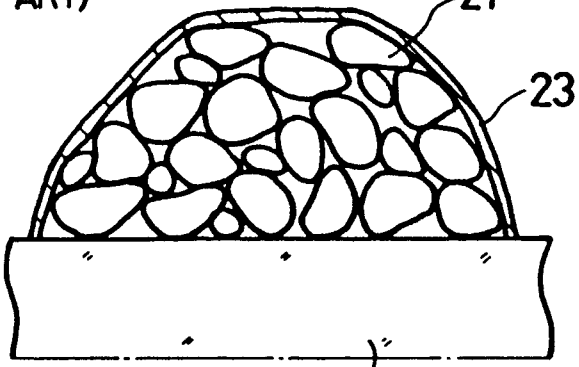
FIG. 1B (PRIOR ART)
Figure 2A:
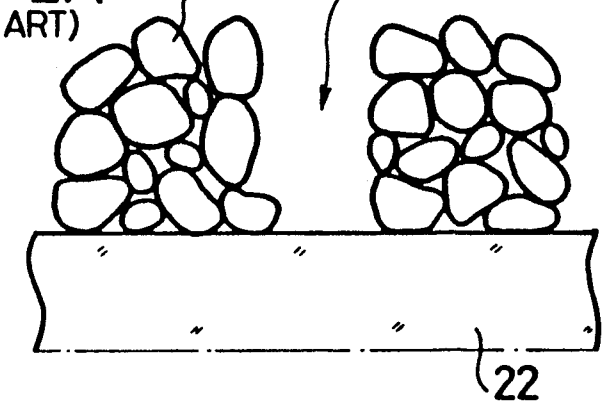
FIG. 2A (PRIOR ART)
FIGS. 2A and 2B are schematic diagrams used to explain the problems of a so-called pinhole of another prior art phosphor screen, respectively.
Figure 2B:
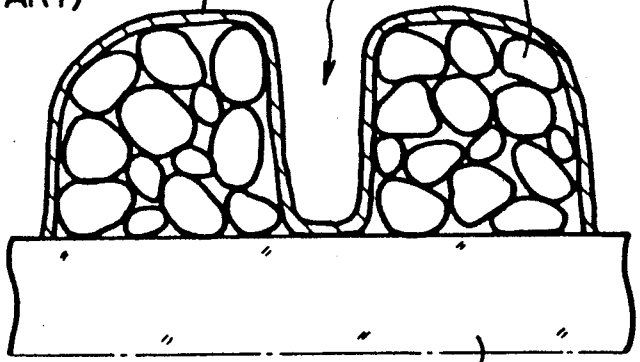
FIG. 2B (PRIOR ART)

An embodiment of a method of manufacturing a phosphor screen for a cathode ray tube according to the present invention will hereinafter be described with reference to FIGS. 3 to 6.

FIGS. 3A to 3I are process diagrams showing an embodiment of a method of manufacturing a phosphor screen for a cathode ray tube according to the present invention, respectively. The respective processes of the present invention will be explained hereinafter in the sequential order.

Resin particles, for example, polyethylene particles (FIG. 3A) having an average particle size of 0.5 to 20 micrometers were mixed into an aqueous solution 1 containing a photosensitive resin made of ammonium bichromate or the like, a dispersing agent such as a surface active agent or the like and a binder such as a polyvinyl alcohol or the like. Then, phosphor particles of a first color, for example, green phosphor particles 3 were added into the above-mentioned aqueous solution 1 with the green phosphor particles 3 and then the solution was stirred for a few minutes, for example, 2 to 3 minutes to provide a suspension 4 (see FIG. 3A). Then, the suspension 4 was uniformly coated on the inner surface of a panel 6 (FIG. 3B) on which there were previously formed carbon stripes 5. After the drying process, the product was exposed to light through an optical mask 7 (FIG. 3C), such as a color selection electrode. After the exposing process, the product was developed by water to form a green phosphor stripe 9G and so-called blank portions 8 formed between predetermined carbon stripes 5 (see FIG. 3D). Similarly, phosphor stripes of second and third colors, for example, blue phosphor stripes 9B and red phosphor stripes 9R were formed on the other blank portions 8 (see FIG. 3E).

Figure 3A:
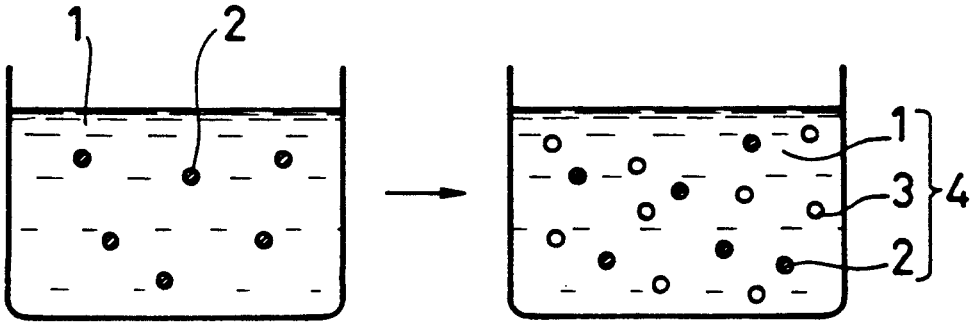
FIGS. 3A to 3I are process diagrams showing an embodiment of a method of manufacturing phosphor screen for a cathode ray tube according to the present invention.
Figure 3B:
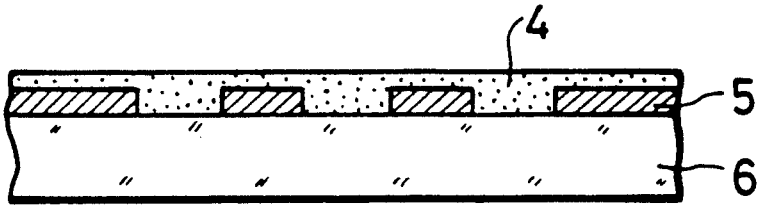
Figure 3C:
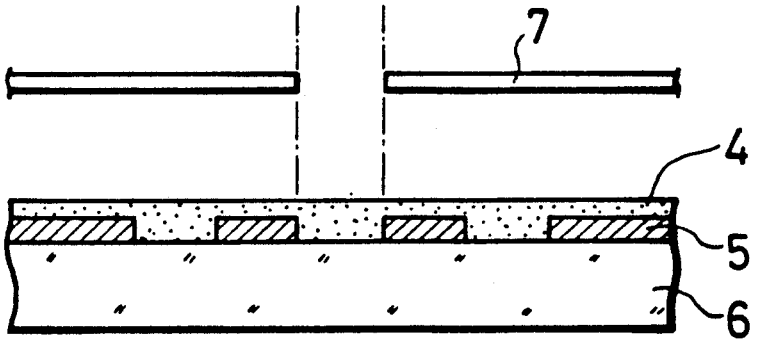
Figure 3D:
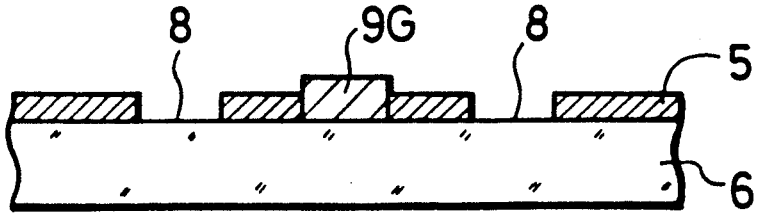
Figure 3E:
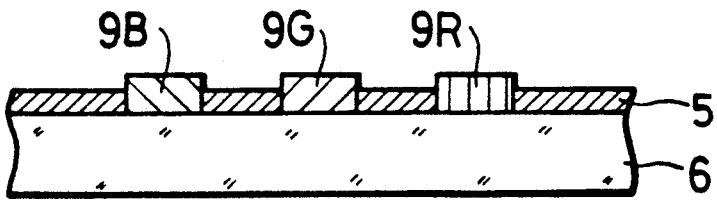
Figure 3F:
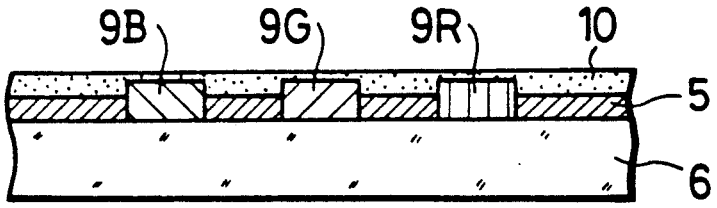
Figure 3G:
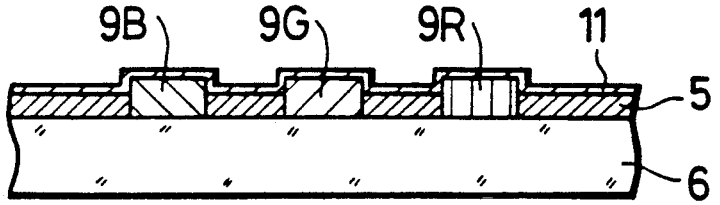
Figure 3H:
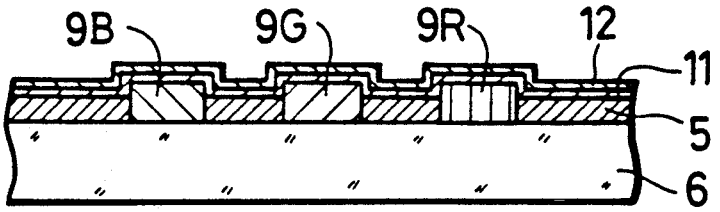

An acrylic resin solution 10 was uniformly coated on the whole surface of the product including the phosphor stripe 9 (9G, 9B and 9R) as shown in FIG. 3F and was then dried to form an acrylic resin-based intermediate film 11 (see FIG. 3G). Thereafter, an aluminum film was formed on the intermediate film 11 as the metal back layer 12 through the aluminum vapor deposition process to form a product illustrated in FIG. 3H. Then, the product was wholly baked. Thus, the process for manufacturing the phosphor screen according to the embodiment of the present invention was finished (see FIG. 3I).

The action of the polyethylene particle 2 on the phosphor particle 3 in the stage from the process for forming the phosphor stripe to the baking process will be described with reference to FIGS. 4A, 4B and FIGS. 5A, 5B. in this case, only the action of the polyethylene particle 2 in the green phosphor stripe 9G will be described for simplicity because the polyethylene particles 2 in the blue and red phosphor stripes 9B and 9R achieve the same or similar actions and effects.

Figure 4A:
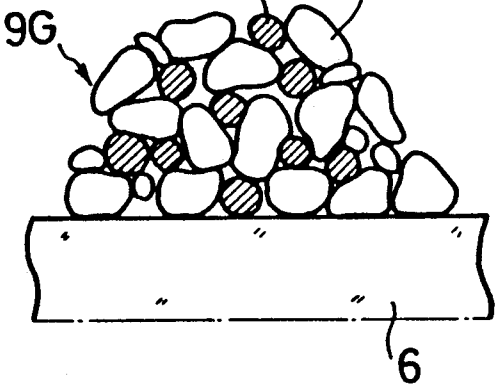
FIGS. 4A and 4B are schematic diagrams used to explain the action of a phosphor particle and a resin particle according to the present invention, respectively.
Figure 4B:
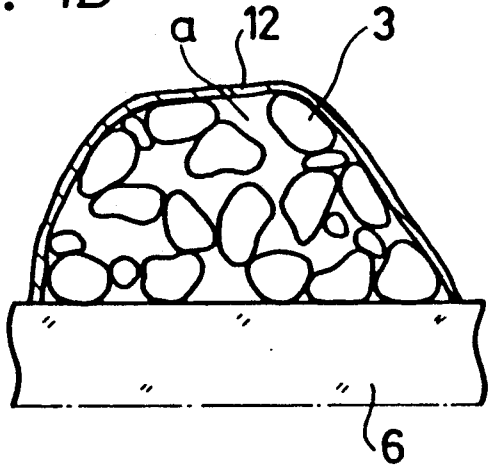

In the stage in which the phosphor stripe 9G was formed, as shown in FIG. 4A, the phosphor particles 3 and the polyethylene particles 2 are randomly arranged on the panel 6 and the phosphor particles 3 themselves were not brought in contact with one another due to the existence of the polyethylene particles 2, which separate the phosphor particles 3. When under such condition, the intermediate film 11 and the metal back layer 12 were formed and the product was wholly baked, the polyethylene particle 2 between the phosphor particles 3 and the intermediate film 11 formed beneath the metal back layer 12 are both removed by the baking step (see FIG. 4B). When the polyethylene particle 2 was baked, a spacing a occurred between the adjacent phosphor particles 3, in particular, in the portion in which the polyethylene particles 2 were present before, baking to reduce contact between the phosphor particles 3. Thus, the brightness of the phosphor screen will be increased.

Figure 5A:
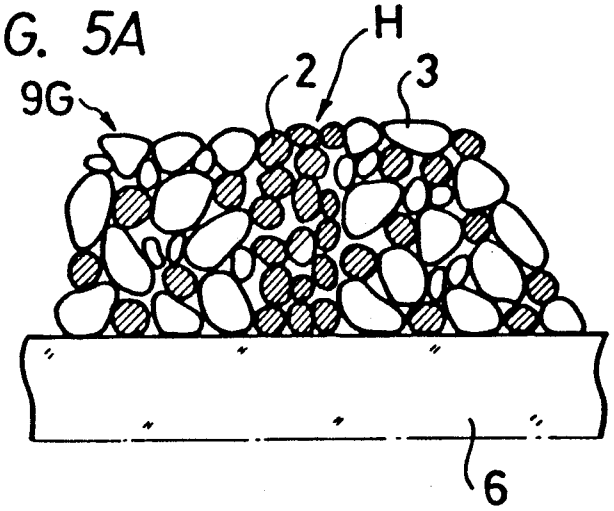
FIGS. 5A and 5B are schematic diagrams used to explain the actions of the phosphor material and the resin particle in the pinhole of the phosphor screen according to the present invention, respectively.
Figure 5B:
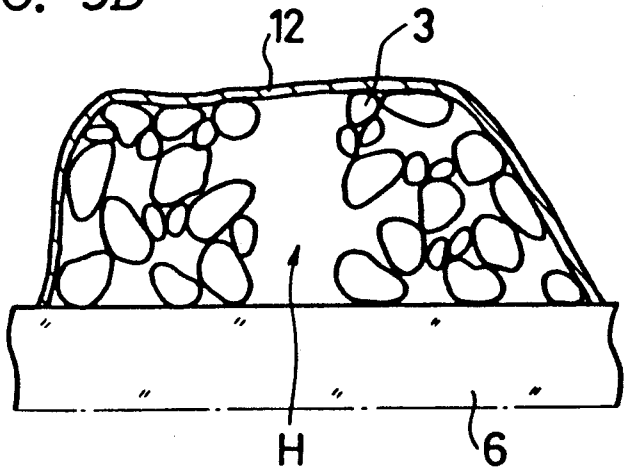

In the stage in which the phosphor stripe 9G was formed, if phosphor particles having poor dispersing property are used, due to the eccentric or displaced dispersion thereof, the pinhole H is formed in the phosphor stripe 9G. However, the polyethylene particles 2 enter into the pinhole H randomly as well as being between the phosphor particles 3, so that the polyethylene particles 2 fill up the pin-hole H (see FIG. 5A). If the intermediate film 11 and the metal back layer 12 were formed under the above-mentioned condition, the intermediate film 11 and the metal back layer 12 were prevented from entering the pinhole H so that they were substantially formed along the upper surface of the phosphor strip 9G. Thus, when the product was baked, the metal back layer 12 was formed to smoothly cover the upper surface of the pinhole H, as shown in FIG. 5B. Under this condition, if the electrons struck the phosphor particles 3, then the light beams emitted from the phosphor particles 3 were reflected on the surface of the metal back layer 12 near the pinhole H by the mirror surface effect of the metal back layer 12, thus preventing the brightness from being lowered by the existence of the pinhole H.

Figure 6:
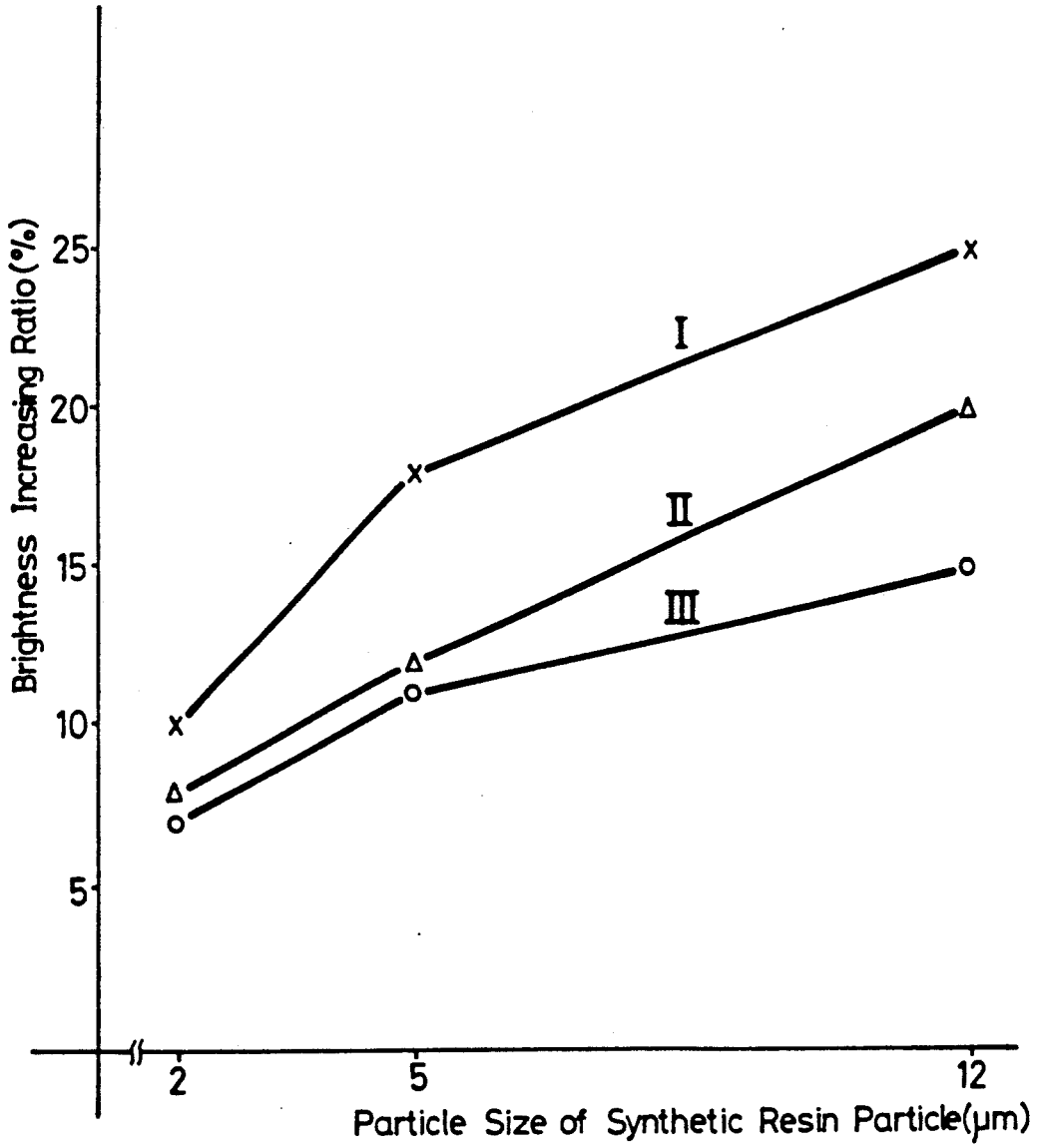
FIG. 6 is a characteristic graph showing a change of an increasing ratio of the brightness with respect to the diameters of the phosphor material and the resin particle.

FIG. 6 shows how the brightness was changed by the particle size of the resin particle (polyethylene particle) 2 relative to the phosphor particle 3.

In the characteristic graph forming FIG. 6, graph lines I, II and III illustrate a change in brightness with an increase in size of the resin particles. Line I is for an average particle size of the phosphor particle 3 which is selected as 12 micrometers; line II is for an average particle size of 6 micrometers for the phosphor particles 3; and line III is for an average particle size for the phosphor particles 3 of 3 micrometers. The average particle sizes of the resin particle 2 were plotted for 2 micrometers, 5 micrometers and 12 micrometers, respectively.

From FIG. 6, it is, thus, apparent that the larger the average particle sizes of the phosphor particle 3 and the resin particle 2 become, the more the brightness is increased. The reason for this is considered such that with the increase of the particle size of the phosphor particle 3 and the resin particle 2 (within the range of particle size that the phosphor particle can be used as a phosphor material), more spacing is apt to be produced in the phosphor screen, thus increasing its brightness.

Since, according to the above described method of manufacturing a phosphor screen for a cathode ray tube of the present invention, the phosphor particles 3 and the resin particles 2 having an average particle size of 0.5 to 20 micrometers are both suspended in an aqueous solution 1 made of the photosensitive resin, the dispersing agent and the binder to provide the suspension 4 and this suspension 4 is used to form the phosphor stripe 9, a resin particle 2 is located between the adjacent phosphor particles 3 and the resin particle 2 prevents the phosphor particles 3 from contacting with one another. After the baking process, the place in which the resin particle 2 is located is left as the spacing a so that the phosphor particles 3 are hardly in contact with one another and allow the light emission of the phosphor particle 3, which is created by the bombardment of electrons to be sufficiently demonstrated as the brightness of the phosphor screen.

Further, in the stage for forming the phosphor screen, even when the pinhole H is formed by the displacement or eccentric dispersion of the phosphor particles 3, the resin particles 2 enter the pinhole H to fill the pinhole H with the resin particles 2. Therefore, when the metal back layer 12 is formed, the metal back layer 12 is formed smooth, thus preventing the brightness from being deteriorated due to the existence of metal layers in the pinhole H.

Figure 3I:
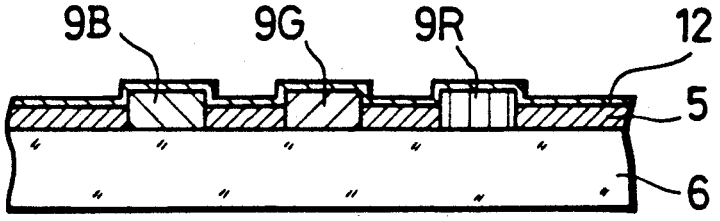

While in the above-mentioned embodiment, the polyethylene particle is used as the resin particle 2, it is possible to use other resins whose particle sizes can be freely selected and which can be perfectly removed in the baking process (FIG. 3I). The resin particle may be other resin particle than the polyethylene particle and it might be, for example, polystyrene particle.

According to the method of manufacturing a phosphor screen for a cathode ray tube of the present invention, since the phosphor particles and the resin particles having the average particle size of 0.5 to 20 micrometers are suspended in the aqueous solution containing the photosensitive resin, the dispersing agent and the binder to provide the suspension, this suspension is coated on the inner wall of the cathode ray tube to form the phosphor screen, thereafter the intermediate film is formed on the phosphor screen, the metal back layer is formed on the upper surface of the intermediate layer and then the product is wholly baked, in the stage for forming the phosphor screen, the phosphor particles and the resin particles coexist in a mixed condition while in the baking process, the resin particles are baked to be removed and to provide the spacings. Thus, the phosphor particles are prevented from contacting with one another and the light emission of the phosphor material can be sufficiently demonstrated as the brightness of the phosphor screen.

Furthermore, even when the pinhole is formed in the phosphor stripe, the resin particles enter the pinhole to prevent the metal back layer from entering the pinhole. Thus, the metal back layer is prevented from entering the pinhole so that the brightness of the phosphor screen of the cathode ray tube can be prevented from being deteriorated.

It should be understood that the above description is presented by way of example of a single preferred embodiment of the invention and it will be apparent that many modifications and variations thereof could be effected by one with ordinary skill in the art without departing from the spirit and scope of the novel concepts of the invention so that the scope of the invention should be determined only by the appended claims.

I claim:

1. A method of manufacturing a phosphor screen for a cathode ray tube comprising the steps of:

(a) preparing a suspension by suspending phosphor particles and resin particles into an aqueous solution containing a photosensitive resin, a dispersing agent and a binder, said resin particles having an average particle size in a range of from over 2.0 to 12 micrometers, said resin particles being made of a resin selected from a group consisting of polyethylene and polystyrene;

(b) coating an inner surface of a cathode ray tube panel with a layer of said suspension to form a phosphor layer;

(c) drying the phosphor layer and then exposing the phosphor layer to light through an optical mask to form an exposed layer containing exposed portions and unexposed portions;

(d) developing the exposed layer by removing the unexposed portion with water to form a phosphor pattern;

(e) forming an intermediate layer of acrylic resin on said phosphor pattern;

(f) forming a metal back later on said intermediate film; and then (g) baking the product to remove said intermediate layer and resin particles and to provide a spacing between the phosphor particles.

* * * * *